United States Patent [19]

Schuster

[11] 4,239,484

[45] Dec. 16, 1980

[54] VACUUM OVEN WITH GAS COOLING DEVICE

[75] Inventor: Rolf Schuster, Hanau, Fed. Rep. of Germany

[73] Assignee: Deutsche Gold- und Silber-Scheideanstalt vormals Roessler, Frankfurt, Fed. Rep. of Germany

[21] Appl. No.: 62,779

[22] Filed: Aug. 1, 1979

[30] Foreign Application Priority Data

Sep. 13, 1978 [DE] Fed. Rep. of Germany ..... 2839807

[51] Int. Cl.[3] ..... F27D 15/02

[52] U.S. Cl. ..... 432/77; 432/81; 34/20

[58] Field of Search ..... 432/77, 78, 81, 85, 432/205; 34/66, 67, 20, 229, 222; 134/180, 181, 199, 200

[56] References Cited

U.S. PATENT DOCUMENTS

| | | | |
|---|---|---|---|
| 1,637,376 | 8/1927 | Gibney | 134/181 |
| 2,704,082 | 3/1955 | Jackson | 134/200 |
| 3,162,205 | 12/1964 | Bolkow et al. | 134/180 |
| 3,198,503 | 8/1965 | Eichelberg et al. | 432/81 |
| 3,470,624 | 10/1969 | Plotkowiak | 432/81 |

*Primary Examiner*—Henry C. Yuen

*Attorney, Agent, or Firm*—Cushman, Darby & Cushman

[57] ABSTRACT

There is provided a vacuum oven with a gas cooling device with which the heat treated charge for cooling is blown on with a cooling medium from nozzles arranged around it in which the nozzles in the heating chamber are arranged parallel to the axis of the oven and are placed on gas inlet tubes rotatable around its axis.

1 Claim, 1 Drawing Figure

VACUUM OVEN WITH GAS COOLING DEVICE

BACKGROUND OF THE INVENTION

The invention is directed to a vacuum oven having a gas cooling device, in which the heat treated charge is blown on with a cooling medium from nozzles arranged around it for cooling. The cooling device has the task of quickly cooling down the charge and oven again after the ending of an annealing or calcining process.

The quick cooling of a heat threated charge in a vacuum oven can be necessary for economical reasons (better oven loading) or for process engineering reasons (prescribed high cooling rate). As cooling medium in each case there is employed a gas which is circulated whereby it takes up heat from the charge and gives it up again in a cooler. Gas circulator and cooler during this process can be arranged outside the oven; however, it is also possible that the cooling surfaces and the circulating devices can be integrated into the furnace.

In principle there are two methods to lead the gas through the charge-space. The most current type is parallel flow through the heating space wherein the gas enters on one side and leaves on the other. In connection therewith there is concern to maintain constant the velocity over the cross section of the oven. These methods have the disadvantage that very large amounts of gas must be circulated in order to produce a high heat transfer number, since the gas velocity produces a decisive size for this and flow cross section for the most part are very large.

Another type of gas cooling takes place via nozzles. In this case the charge space is surrounded by numerous nozzles. The gas flows centrally into the charge chamber through these nozzles, the gas escapes from the charge chamber through leaks in the insulation or through deliberately installed openings therein, is led through a cooler and is again pushed through the nozzles from a compressor.

Compared to parallel flow these cooling methods have the advantage that the required cooling velocity can be attained with substantially smaller amounts of gas. Of course thereby a higher pressure is necessary so that the circulating capacity is about the same size in both cases. The higher pressure needed does not require additional expense of construction while the smaller amounts of gas in the nozzle cooling reduces the expense of construction considerably.

In spite of these advantages the nozzle cooling is not always usable since it normally produces nonuniform cooling results inside the charge. Deviations of more than one 100% are no rarity. Through this there arise in the charge large temperature differences, with all the negative consequences such as high internal stresses, danger of cracks and deformation.

Therefore it was the problem of the present invention to provide a vacuum oven with a gas cooling device in which the heat treated charge for cooling is blown with a cooling medium from nozzles arranged around it and which makes possible a uniform cooling of the heat treated charge.

SUMMARY OF THE INVENTION

This problem was solved according to the invention by arranging the nozzles in the heating chamber parallel to the axis of the oven fitted on tubes rotatable around its axis. The previously rigidly mounted nozzles according to the invention are arranged swivelingly. By this procedure there is avoided only one area of the charge being blown on which the neighboring area lies in the shade of the gas flow and as a result is cooled more slowly. Also the path of the gas in the interior of the charge is constantly charged through the swiveling of the nozzles. In this way it is possible to reduce deviations in heat transfer values from above 100% to about 25%. The nozzles are fitted on tubes which run parallel to the axis of the oven. The swiveling of the nozzles takes place by twistingly turning these tubes in each case around a fixed angle. In connection therewith it is advantageous to allow the tubes to project one-sidely from the heating chamber in order to hold small the short circuiting of heat. There can advantageously be mounted on the tubes outside the heating chamber the connection to the pressure gas supply via flexible tubes and the drive for the oscillating motion.

DESCRIPTION OF THE PREFERRED EMBODIMENTS

Figure 1:
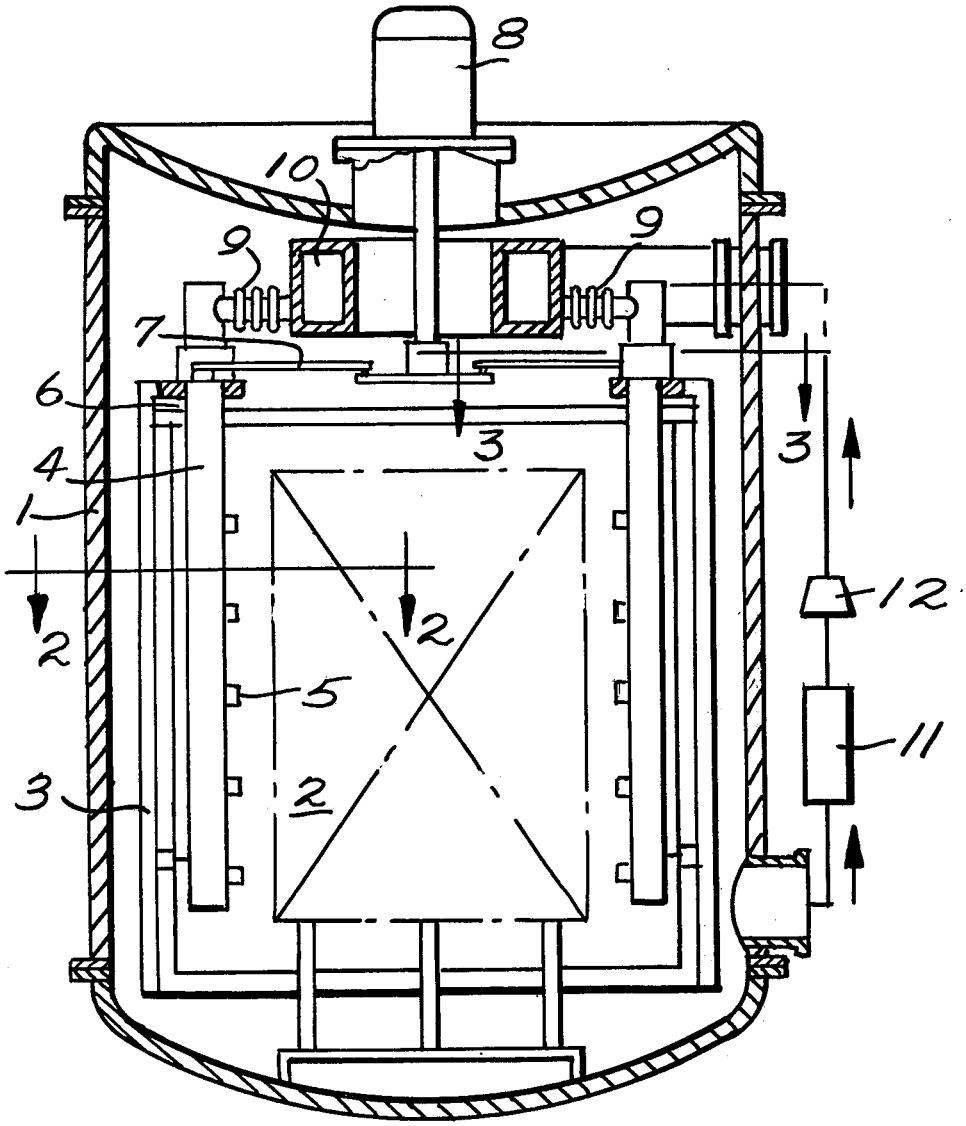
FIG. 1 illustrates schematically a vacuum oven according to the invention in longitudinal section.
Figure 2:
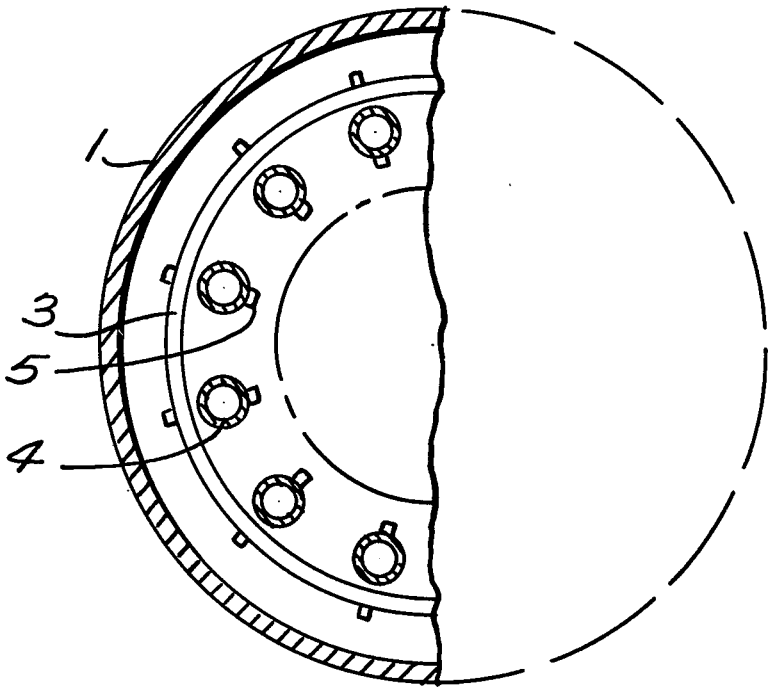
FIG. 2 is cross section along the line 2—2 of FIG. 1.
Figure 3:
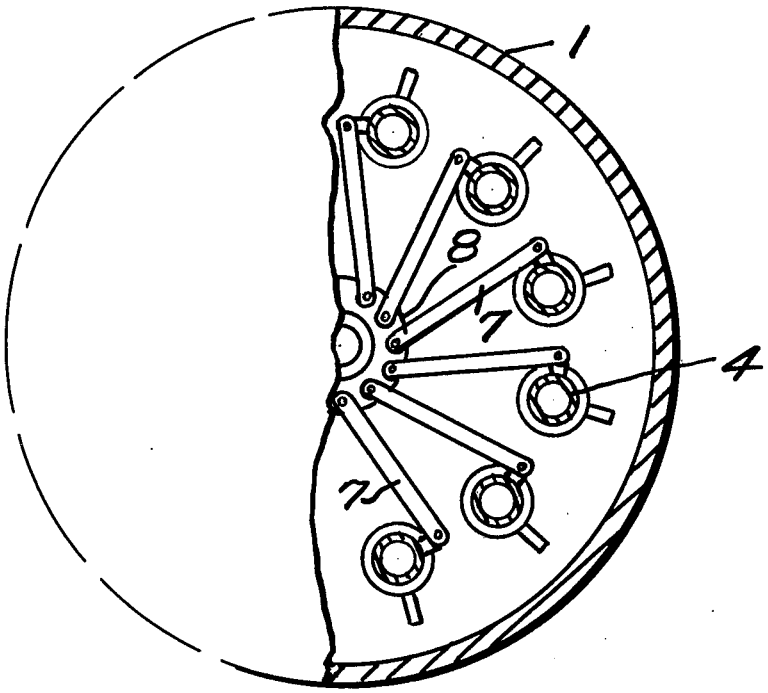
FIG. 3 is a cross section along the line 3—3 of FIG. 1.

Referring more specifically to the drawings the oven (or furnance) is surrounded by a water cooled housing 1. The true heating chamber 2 is enclosed by the heat insulation 3 which can consist of, e.g., graphite felt or radiation shields. The gas inlet tubes 4 with the nozzles 5 project through the heat insulation 3 into the heating chamber 2. The gas inlet tubes 4 made of materials suitable for the working temperature, e.g. graphite or molybdenum are journaled in rotatable bearings 6 via the rods 7 from the oscillatingly driven drive 8. The gas inlet tubes 4 are connected via flexible tubes (or hoses) 9 to the gas supply system 10. The outer gas passage with the gas cooler 11 and the gas compressor 12 is depicted schematically in FIG. 1. The cooling process after the vacuum annealing (calcining) is started through flooding the housing 1 with gas. The gas compressor 12 sucks in the gas via the gas cooler 11 and forces it into the gas distribution system 10 and from there out into the gas inlet tubes 4. Now the gas can flow out of the nozzles 5 and cool the charge of the heating chamber. The gas leaves the heating chamber via leaks in the heat insulation 3 and is again sucked out of the housing 1 by the compresser 12. The drive 8 during the cooling time completely carries on slowly an oscillating motion in which its shaft for example reciprocatingly turns about 60°. This movement is carried to the gas inlet tubes 4 via the rod 7. The nozzles 5 fixedly arranged on the gas inlet tubes 4 reciprocatingly swivel around the same angle of rotation so that all places in the charge are provided with the cool stream.

The oven can comprise, consist essentially of or consist of the elements set forth.

The entire disclosure of German priority application No. P 28 39 807.4 is hereby incorporated by reference.

What is claimed is:

1. A vacuum oven having a heating chamber and gas cooling means adapted to blow on a charge in the heating chamber of the oven with a cooling medium from nozzles arranged around the oven, said nozzles being arranged parallel to the axis of said oven and being positioned on gas inlet tubes rotatable around the axis of the oven; and drive means for reciprocating motion wherein the heating chamber is provided with heat insulation and the gas inlet tubes project one-sidely out of the heat insulation chamber and are connected on these outer ends via flexible tube means with a fixed gas supply system and connected to said drive means for reciprocating movement.

* * * * *